US007262561B2

(12) United States Patent
Chou et al.

(10) Patent No.: US 7,262,561 B2
(45) Date of Patent: Aug. 28, 2007

(54) METHOD FOR CONTROLLING POWER SUPPLY THROUGH MULTIPLE MODULATION MODES

(75) Inventors: Chin-Wen Chou, Hsin-Tien (TW); Ying-Nan Cheng, Hsin-Tien (TW); Kuang-Ming Wu, Hsin-Tien (TW); Chin-Biau Chung, Hsin-Tien (TW)

(73) Assignee: Zippy Technology Corp., Taipei Hsien (TW)

( * ) Notice: Subject to any disclaimer, the term of this patent is extended or adjusted under 35 U.S.C. 154(b) by 143 days.

(21) Appl. No.: 11/009,076

(22) Filed: Dec. 13, 2004

(65) Prior Publication Data

US 2006/0125413 A1 Jun. 15, 2006

(51) Int. Cl.
*G05F 1/00* (2006.01)

(52) U.S. Cl. ..... 315/291; 315/307; 323/355; 310/314

(58) Field of Classification Search ..... 315/224, 315/291, 307, 209 R, 169.1, 219, 308; 363/21.02, 363/21.03, 97, 16, 21, 21.01; 323/355; 310/311, 310/314, 318
See application file for complete search history.

(56) References Cited

U.S. PATENT DOCUMENTS 4,965,496 A * 10/1990 Haferl ..... 315/371
5,456,241 A * 10/1995 Ward ..... 123/598
5,689,407 A * 11/1997 Marinus et al. ..... 363/21.15
5,812,383 A * 9/1998 Majid et al. ..... 363/21.05
5,923,542 A * 7/1999 Sasaki et al. ..... 363/16
5,939,830 A * 8/1999 Praiswater ..... 315/169.3
6,634,555 B1 * 10/2003 Sorrells et al. ..... 235/462.25
6,690,591 B2 * 2/2004 Min ..... 363/97
6,864,644 B2 * 3/2005 Kernahan ..... 315/307
7,183,692 B2 * 2/2007 Chou et al. ..... 310/318

* cited by examiner

*Primary Examiner*—Douglas W. Owens
*Assistant Examiner*—Jimmy Vu
(74) *Attorney, Agent, or Firm*—Birch, Stewart, Kolasch & Birch, LLP

(57) ABSTRACT

A method for controlling power supply through multiple modulation modes aims to control an inverter of a selective characteristic through a cycle control signal of varying modulation modes to ensure that the inverter and the load on the rear end function in a reliable characteristic range and prevent the load from aging too quickly. The method includes generating a cycle control signal which includes ON-Time and OFF-Time, and adding a regulation energy of varying amplitudes or frequencies in the OFF-Time to provide varying modulation modes by mixing duty cycle, frequency modulation and amplitude modulation. The power supply can be controlled with a high reliability and a wide dynamic range.

9 Claims, 10 Drawing Sheets

METHOD FOR CONTROLLING POWER SUPPLY THROUGH MULTIPLE MODULATION MODES

FIELD OF THE INVENTION

The present invention relates to a method for controlling power supply and particularly to a power supply control method that controls an inverter through a cycle control signal of varying modulation modes to provide power supply control in a high reliability and a wide dynamic range.

BACKGROUND OF THE INVENTION

The conventional control method for power supply or energy regulation, such as dimming control, generally adopts time cycle with an ON-OFF interval to regulate ON-OFF cycle (T1, T2) ratio to get different output energy (referring to FIG. 1). The excitation dynamical ratio (EDR) obtained by means of such an approach may be defined by equation-1 depicted below:

$$\approx \frac{E_1(\text{ON-Energy cycle})}{E_2(\text{OFF-Energy cycle})}, \qquad \text{(equation-1)}$$

The conventional EDR is $$\frac{E_1}{E2 \approx 0} \Rightarrow \infty$$

Based on equation-1, the conventional EDR is infinite. (Its meaning is similar to bending a steel wire to 90 degrees and straightening again. If the process is repeated many times, the steel wire will be ruptured. If the steel wire is bent only 10 degrees, it can be bent many more times than by bending 90 degrees before ruptured). The conventional energy control method set forth above has a great impact to the life span of the load. When the EDR is excessively large, the load has to function in two extreme conditions, and aging of the load is accelerated.

Another conventional method to control power supply (referring to FIGS. 2, 3 and 4) adopts EDR as follow:

$$\frac{E_A}{E_A} = 1,$$

(Referring to FIG. 2)

Total energy $$\frac{EA \times 1(T_{TOTAL})}{T_{TOTAL}}$$

(Maximum energy output)

EDR:

$$\frac{\frac{1}{2}EA}{\frac{1}{2}EA} = 1$$

(Half energy output), (Referring to FIG. 3)

$$\frac{1}{2}\text{Total energy} = \frac{\frac{1}{2}EA \times 1}{T_{TOTAL}}$$

EDR:

$$\frac{\frac{1}{10}EA}{\frac{1}{10}EA} = 1,$$

(Referring to FIG. 4)

$$\frac{1}{10}\text{Total energy} = \frac{\frac{1}{10}EA \times 1}{T_{TOTAL}}\left(\frac{1}{10}\text{energy output}\right)$$

The method depicted above also has problems. When total regulation energy changes, the maximum wave amplitude of excitation energy also decreases. It could happen that the load cannot be actuated to function at one half of the amplitude energy (½EA) (such as the lamp cannot be ignited because of the voltage is too low, or some electromechanical elements cannot be activated because of the peak actuation energy is not adequate).

SUMMARY OF THE INVENTION

The primary object of the present invention is to solve the aforesaid disadvantages. The invention provides a standby mode function during OFF-Time to improve the modulation range of the original system and maintain the entire operation of an inverter so that the load may be actuated effectively, thereby to control the inverter and the load effectively to achieve a higher reliability and efficiency for the product, and also prevent the product from aging too quickly.

To achieve the foregoing object, the method for controlling power supply through multiple modulation modes according to the invention provides a cycle control signal of varying modulation modes to control an inverter of selected characteristics and keep the inverter and a load on the rear end to operate within a reliable characteristic range, and prevent the load from aging too quickly. The method of the invention inputs a total energy control regulation signal to an input end of an energy/time ratio synthesizing control unit to get a cycle control signal on an output end thereof that contains an ON-Time and an OFF-Time, and adds a regulation energy of varying amplitudes or frequencies in the OFF-Time during the burst period of two ON_OFF cycles. By regulating the duty cycle, or through frequency modulation and amplitude modulation, the power supply may be controlled with a higher reliability and in a wider dynamic range.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
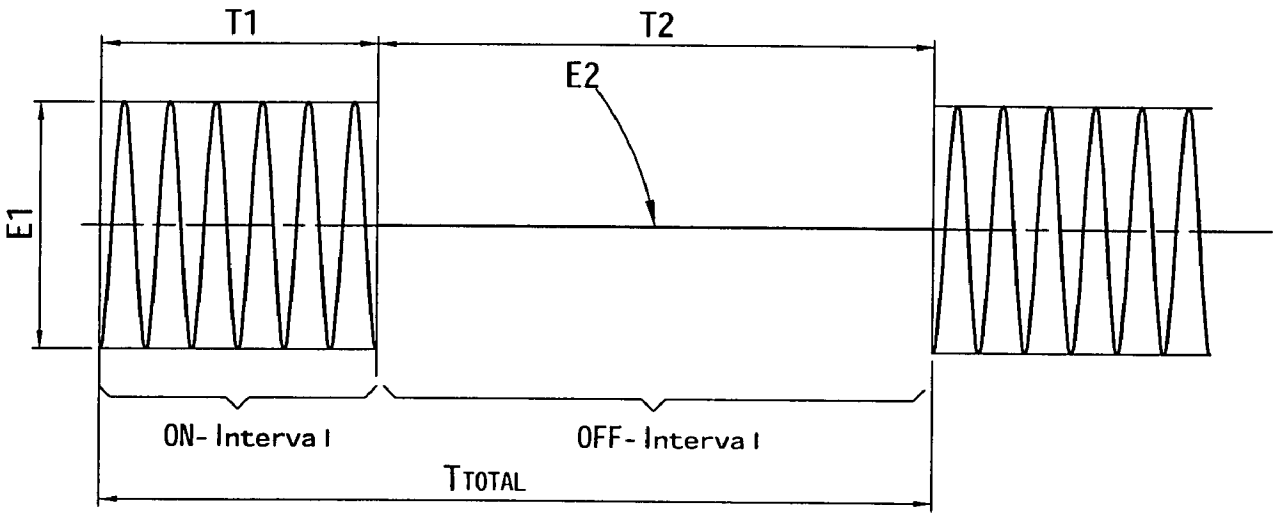
Fig.1 PRIOR ART
FIGS. 1 through 4 are schematic views of waveforms of a conventional power supply control method.
Figure 2:
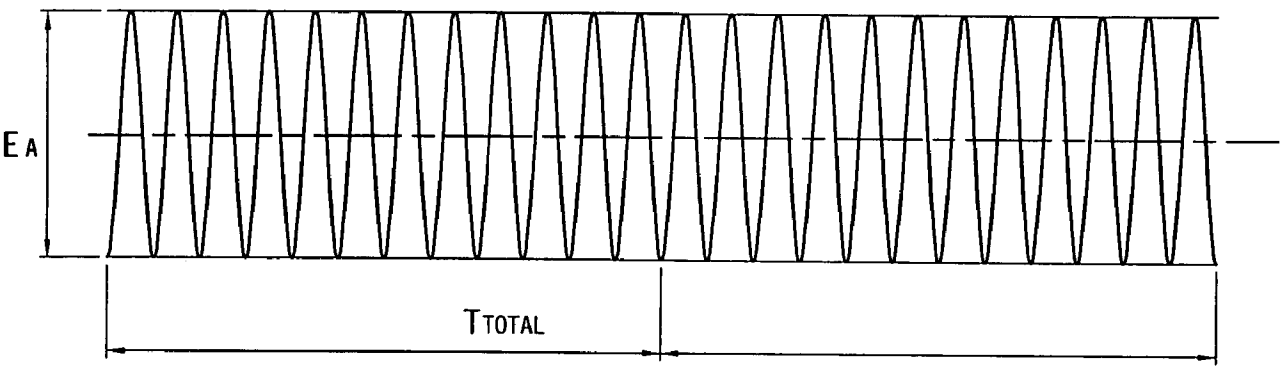
Fig.2 PRIOR ART
Figure 3:
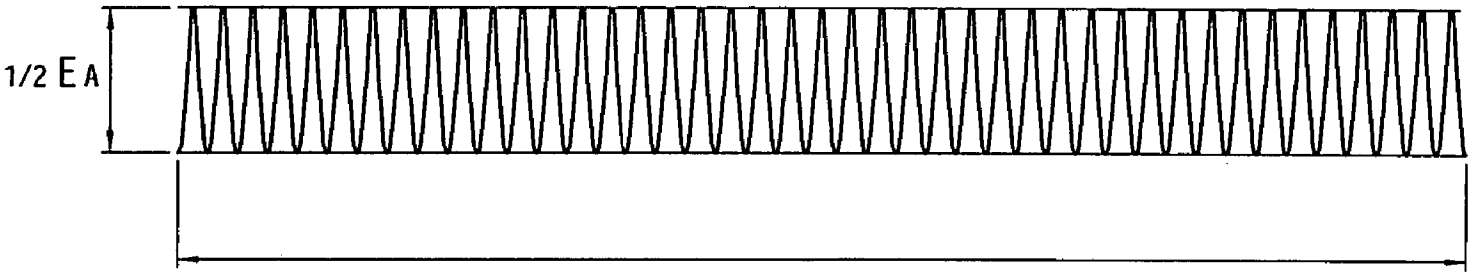
Fig.3 PRIOR ART
Figure 4:
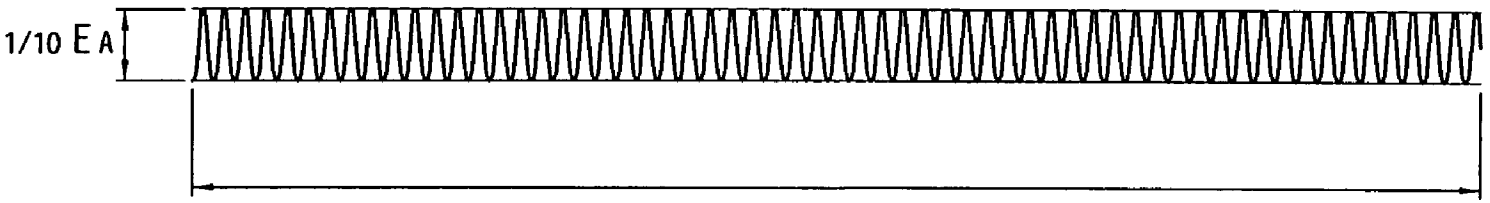
Fig.4 PRIOR ART
Figure 5A:
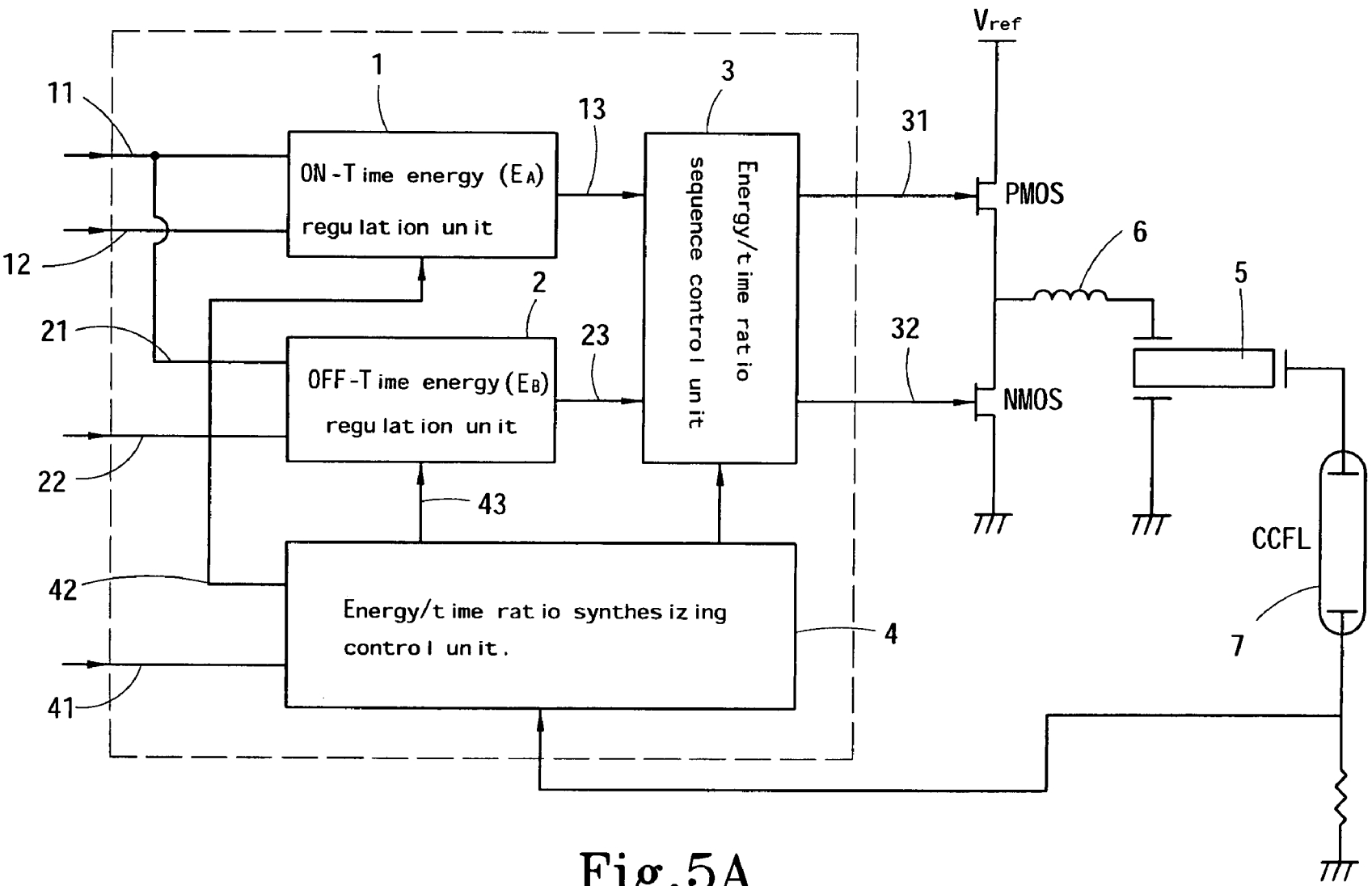
FIG. 5A is a functional block diagram of the control apparatus according to the method of the invention.

Please refer to FIG. 5A for the apparatus to implement the method of the invention. The method for controlling power supply through a multiple modulation mode according to the invention aims to add a regulation energy ($E_B$) of varying modulation modes in the OFF-Time ($T_B$) of a cycle control signal which contains ON-Time ($T_A$) and OFF-Time ($T_B$) to get a new excitation dynamical ratio (EDR) (referring to FIG. 6).

To implement the method of the invention, the apparatus being used include: an ON-Time energy ($E_A$) regulation unit 1, an OFF-Time energy ($E_B$) regulation unit 2, an energy/time ratio sequence control unit 3, and an energy/time ratio synthesizing control unit 4.

The ON-Time energy ($E_A$) regulation unit 1 has two input ends 11 and 12. The input end 11 receives a reference signal of a set duty frequency point. Another input end 12 receives a feedback error signal to adjust the duty width. The ON-Time energy ($E_A$) regulation unit 1 has an output end 13 to output an energy regulation signal of the ON-Time to determine the energy intensity ($E_A$) of the ON-Time and send to the energy/time ratio sequence control unit 3.

The OFF-Time energy ($E_B$) regulation unit 2 also has two input ends 21 and 22. The input end 21 receives the same reference signal of the ON-Time energy ($E_A$) regulation unit 1. Another input end 22 receives an error signal potential to change the time relationship of reference sequence signals. It has an output end 23 to generate another energy regulation signal of the OFF-Time and output to the energy/time ratio sequence control unit 3 to determine the energy intensity ($E_B$) of the OFF-Time. The energy intensity ($E_B$) is smaller than the energy intensity ($E_A$) of the ON-Time.

Figure 5B:
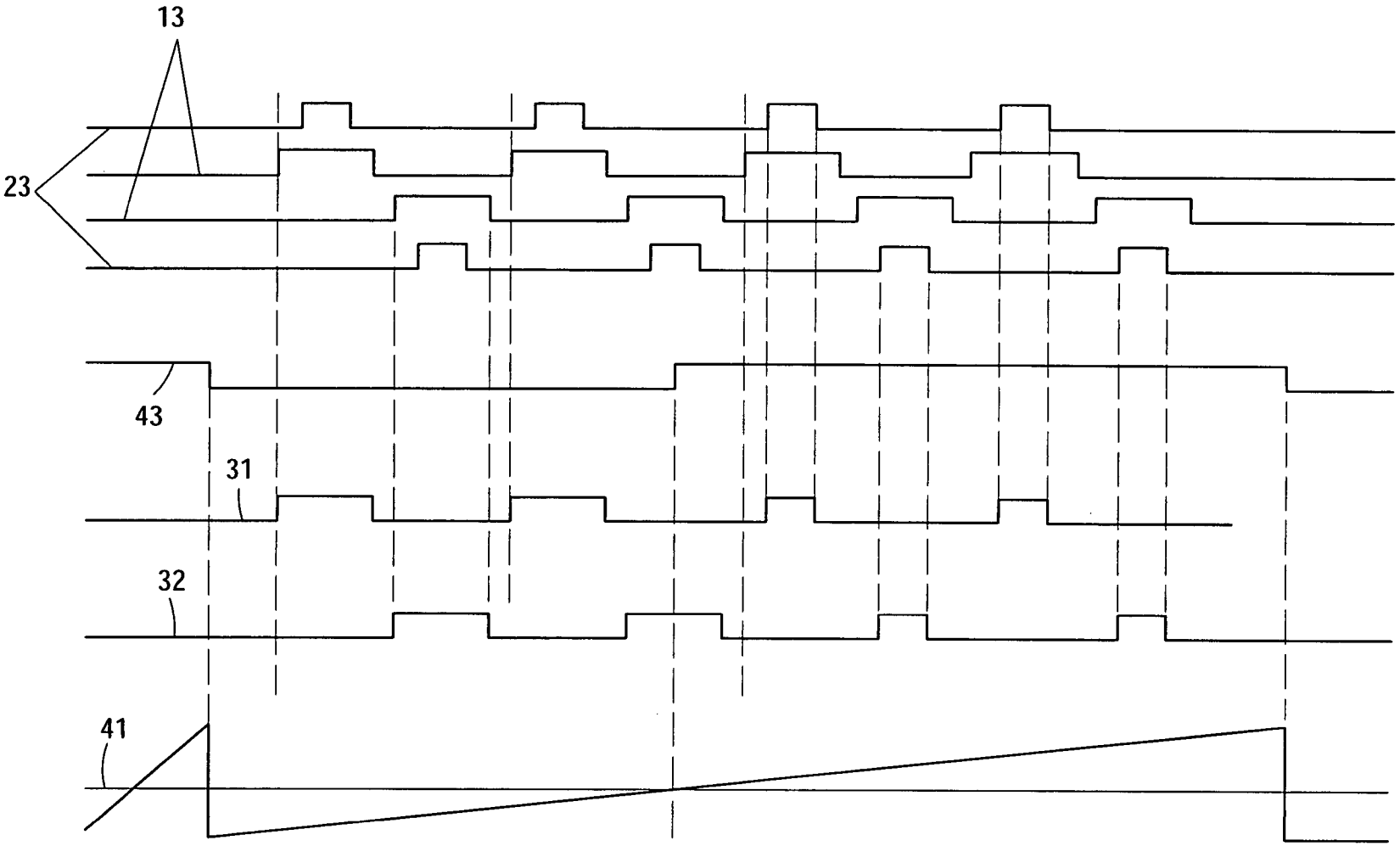
FIG. 5B is a schematic view of signal output waveform sequences of various units shown in FIG. 5A.

The energy/time ratio synthesizing control unit 4 has an input end 41 to receive a total energy control signal which includes an energy regulation ratio of a selected range such as alter from 10% to 100%. It has output ends 42 and 43 to get an ON-Time and OFF-Time cycle control signal ($T_A/T_B$) that is distributed respectively to the ON-Time energy ($E_A$) regulation unit 1 and the OFF-Time energy ($E_B$) regulation unit 2, and output to the energy/time ratio sequence control unit 3. Finally an output end 31 of the energy/time ratio sequence control unit 3 outputs a basic phase control signal (different energy total or control signals generated according to the modulation method of the invention), and another output end 32 outputs a complementary phase control signal which complements the basic phase control signal, thereby to control an external soft resonant component 6 to perform desired energy waveform transformation. Then send the energy waveform (proximate to a sinusoid wave) to a power transfer element 5. The transformed signal (voltage boosting or lowering signal) is sent to a load 7 (such as lamp, rectification circuit, or the like). Please refer to FIG. 5B for the output waveform sequences of various signals To change the output energy amplitude, the duty width is changed without changing the frequency. As the frequency remains the same, the power transfer element 5 that equips with bandpass characteristics can operate on the maximum efficiency point. Since the width is changed, after having output through the soft switching component 6, a voltage wave of smaller amplitude may be obtained. Hence the voltage on the load 7 is changed and a regulation controlling function is accomplished.

Moreover, during regulating the energy intensity, the ON-Time energy intensity ($E_A$) still maintains the maximum energy amplitude and is controlled by the ON-Time energy regulation unit 1. But the OFF-Time energy amplitude ($E_B$) is controlled by the OFF-Time energy regulation unit 2 to add an average energy of the ON-Time ($T_A$) and the OFF-Time ($T_B$) to the regulation input end to regulate the width of another cycle in the OFF-Time ($T_B$). The basic energy amplitude of this width is much smaller than that in the ON-Time ($T_A$). However, on average, an intensity control effect still can be achieved without any intermittent interruption.

Figure 6:
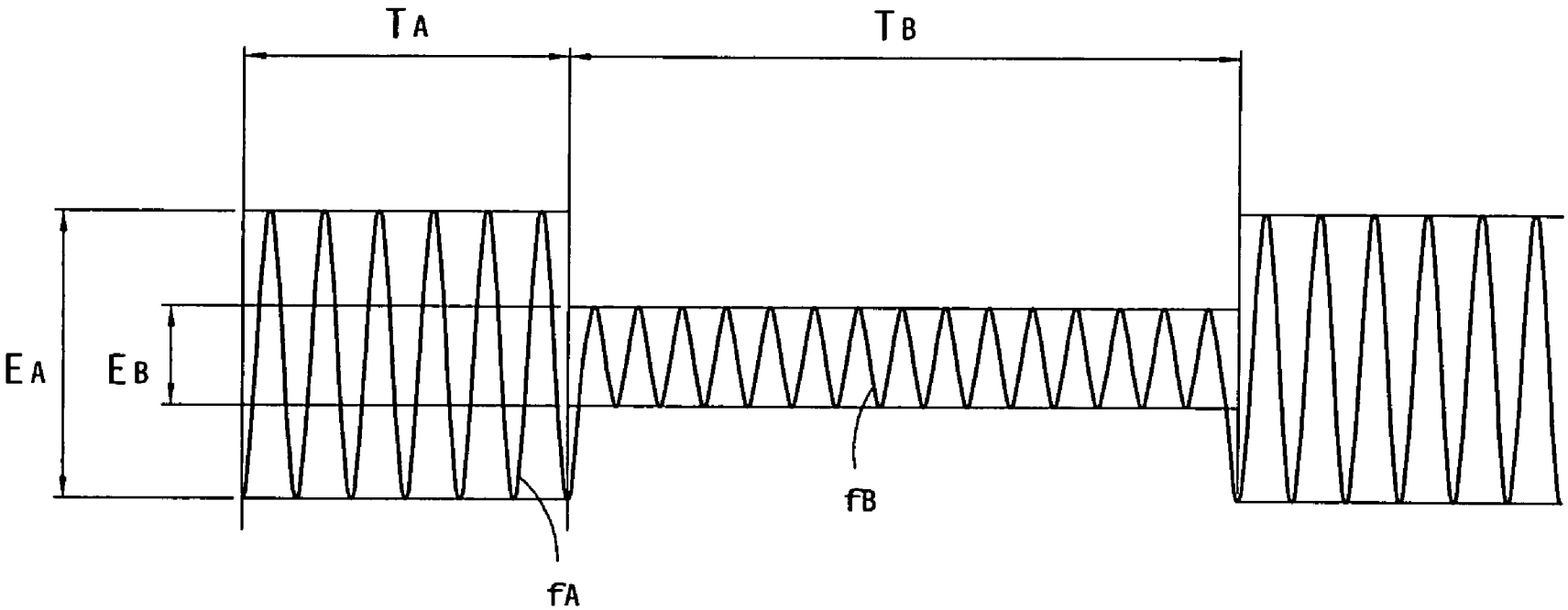
FIGS. 6 through 11 are schematic views of embodiments of the invention showing waveforms of the cycle control signal in varying modulation modes.

On of the embodiments is to adopt constant frequency and regulating duty width, namely altering the duty width (i.e. the length of ON-Time ($T_A$) and the OFF-Time ($T_B$)) without changing the frequency (referring to FIG. 6). As the frequency is fixed ($f_A=f_B$), the power transfer element 5 that equips with bandpass characteristics can operate on the maximum efficiency point (usually in a desired frequency range). Since the width is changed, the soft switching component 6 (referring to FIG. 5A) will get a voltage wave of a smaller amplitude. Hence the voltage on the load 7 is changed and the amplitude regulation controlling function is accomplished. Similarly, the ON-Time ($T_A$) and OFF-Time ($T_B$) may also be implemented in the modes of frequency modulation ($f_A \neq f_B$), constant width (referring to FIG. 7), or frequency modulation and width modulation.

Figure 7:
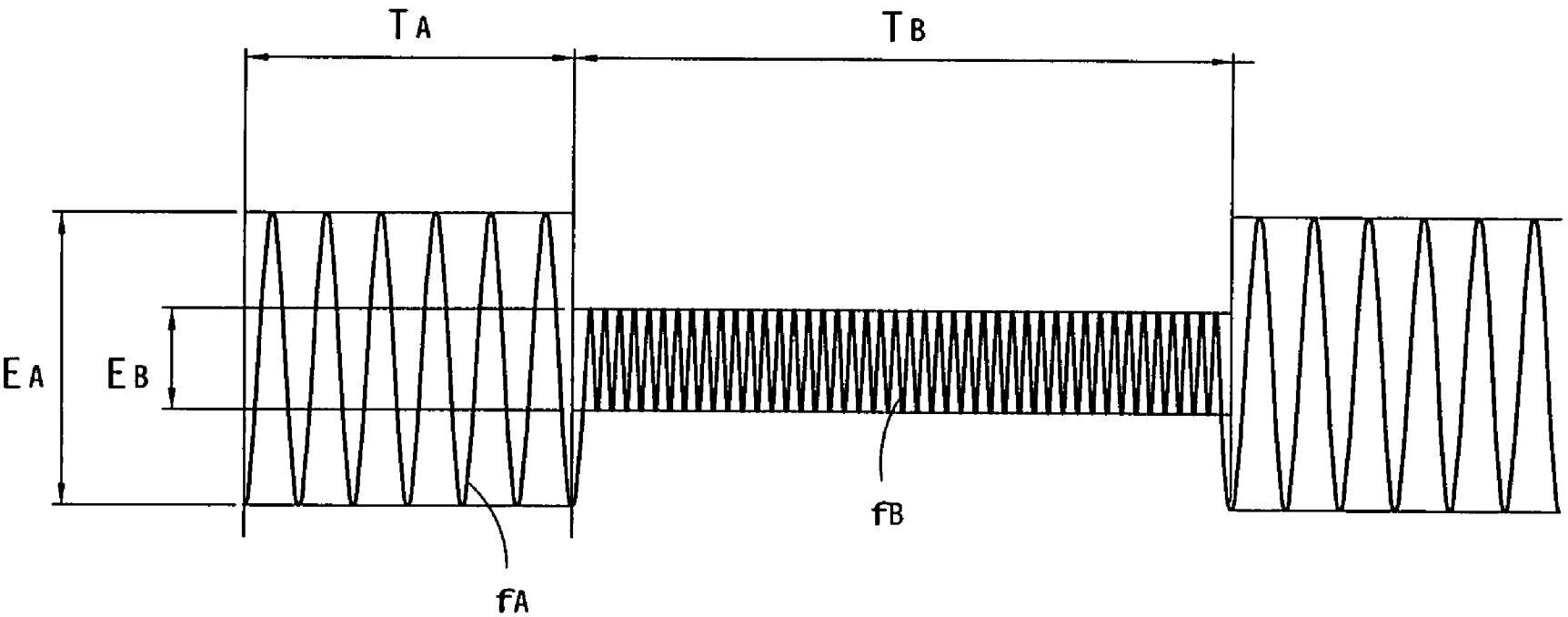

Refer to FIGS. 6 and 7 for another embodiment. As an energy intensity ($E_B$) other then 0 is still maintained during OFF-Time ($T_B$), a standby mode function may be provided to improve the modulation range and enable the total operation of the power transfer element 5 to be maintained without stop. Hence audible noise is inhibited. Moreover, ON-Time ($T_A$) and OFF-Time ($T_B$) provide different energy intensity; the load 7 can be actuated effectively. Hence the power transfer element 5 and the load 7 can be effectively controlled. As a result, the product is more reliable and efficient.

Figure 8:
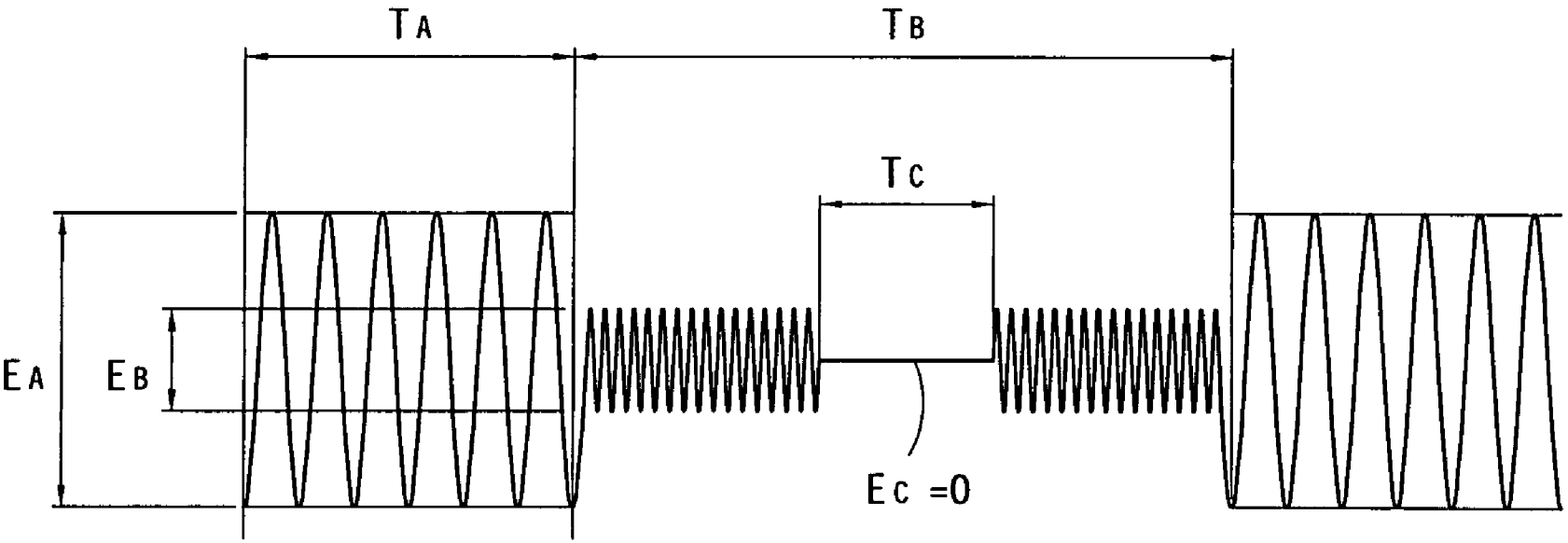

In yet another embodiment, a stop time ($T_C$) of energy intensity 0 ($E_C=0$) is added to the OFF-Time ($T_B$). Then a controllable cycle composition of multiple modulation modes may be realized. And the same result can be achieved (referring to FIG. 8).

Figure 9:
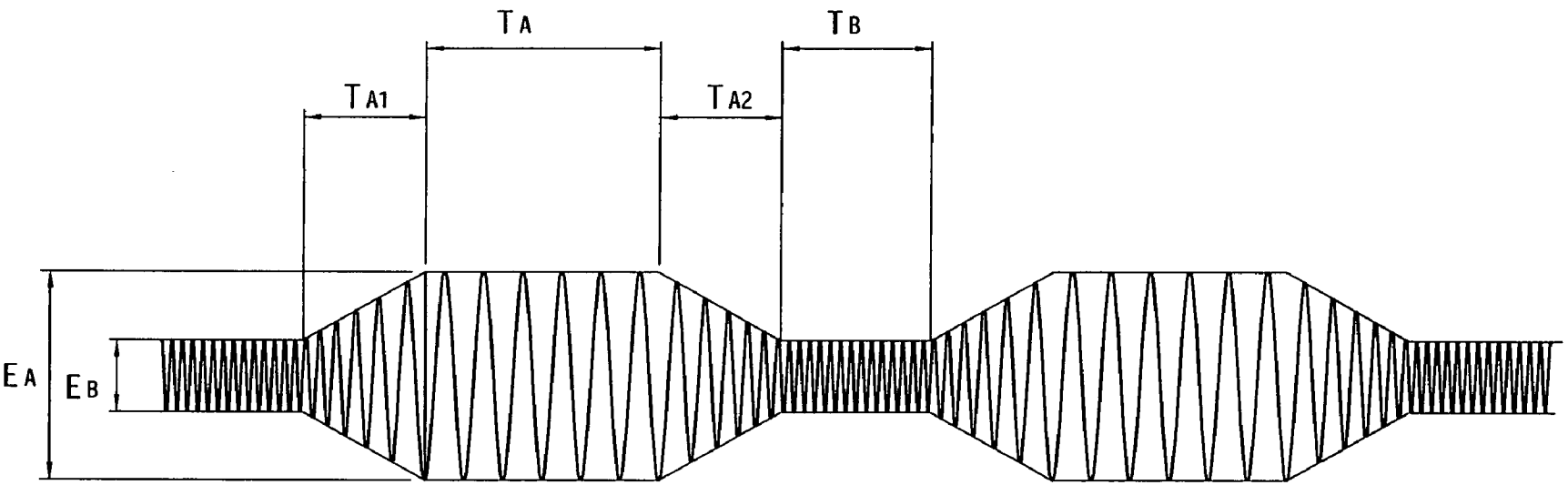
Figure 11:
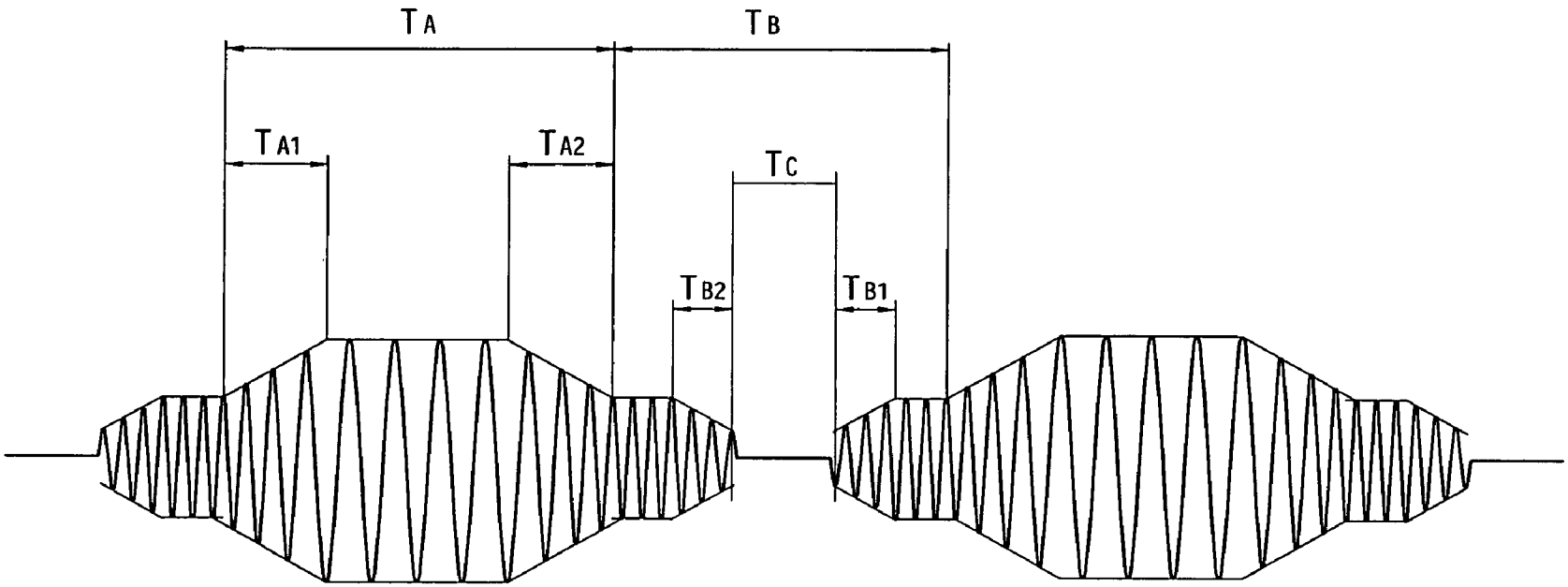

Refer to FIG. 9 for still another embodiment which is a variation of the one shown in FIG. 7. It mainly provides a slowly rising zone ($T_{A1}$) and a slowing lowering zone ($T_{A2}$) on the beginning and ending periods of the ON-Time ($T_A$). It aims to improve the transition period of energy intensity $E_A/E_B$ to prevent too much EDR occurring to the energy intensity $E_A/E_B$. Similarly, based on FIG. 8, a slowly rising zone ($T_{A1}$, $T_{B1}$) and a slowing lowering zone ($T_{A2}$, $T_{B2}$) may be provided respectively on the beginning and ending periods of the ON-Time ($T_A$) and OFF-Time ($T_B$) as shown in FIG. 11.

Figure 10:
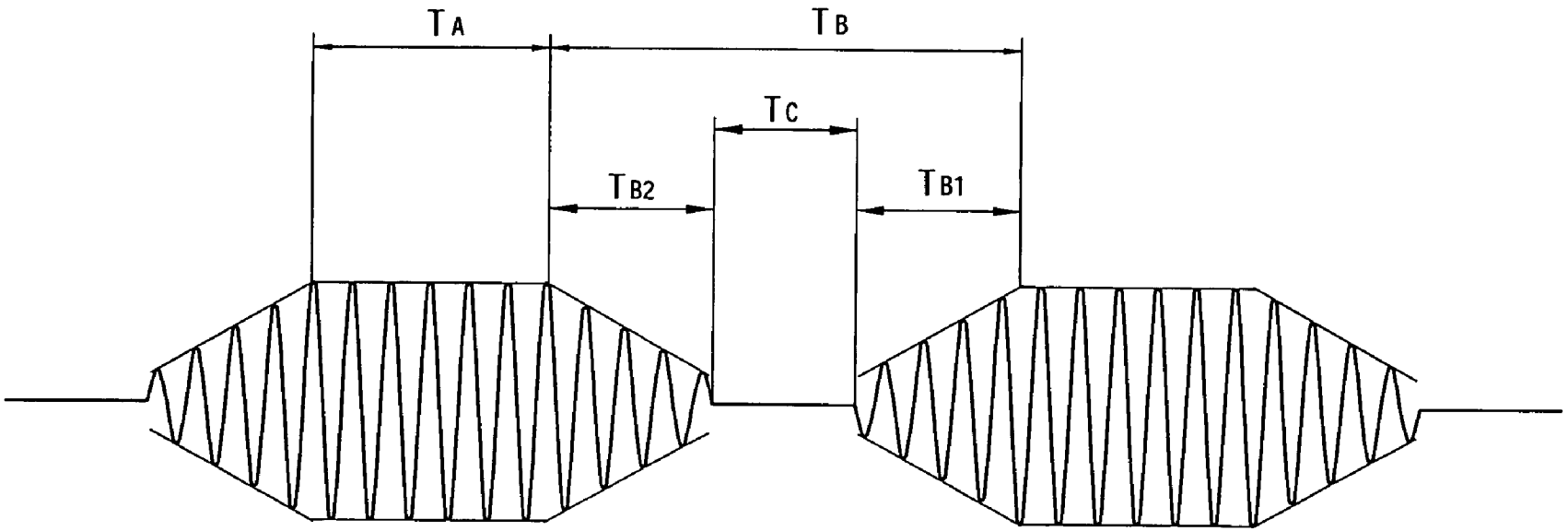

Refer to FIG. 10 for yet another embodiment of the invention. It mainly includes a slowly lowering zone ($T_{B2}$) and a slowly rising zone ($T_{B1}$) before and after the stop time ($T_C$) of the OFF-Time ($T_B$). Such an approach can improve the transition period of the energy intensity $E_A/E_B$ to prevent the EDR of the energy intensity $E_A/E_B$ from being excessively large.

By means of the method previously discussed, after adding a modulation energy $E_B$ of varying amplitudes in the stop time ($T_C$), a new EDR may be obtained as follow:

$$\frac{EA}{EB} << \infty, \text{ Total energy is: } \frac{E_A \times T_A + E_B \times T_B}{T_{TOTAL}} = \frac{E_1 \times T_1}{T_{TOAL}}$$

(where $T_{TOTAL}$ is the burst period).

As the energy sent to the load end is the same, power supply regulation control may be achieved. The EDR is much smaller than the original infinite. Hence the problem of rapid load aging is improved.

In addition, the invention can maintain the original peak dynamic energy and regulate total energy at the same time. Thus the energy regulation dynamic range may be expanded without damaging the life span of the load (whereas, the control signal in $T_A/T_B$ may be constant frequency, width modulation or frequency modulation, constant width, or modulation of both).

Refer to FIG. 9 for the time sequence of an extended buffer interface control according to the invention. It includes waveform alterations of $T_{A2}$ (slowly lowering zone) and $T_{A1}$ (slowly rising zone) that may be in different modes such as constant frequency, frequency modulation, constant width or altering width. It is mainly to improve the transition period of $E_A/E_B$ to prevent $E_A/E_B$ EDR from being too large. Total energy in the burst period may be derived according to the following equation:

$$\text{Total energy} = \frac{E_A \times T_A + E_{(TFI)} \times T_{FI} + E_B \times T_B + E_{(TRI)} \times T_{RI}}{T_{Total}}$$

(where $T_A/T_B$ is the time ratio for energy rationing).

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A method for controlling power supply through multiple modulation modes to control an inverter to perform energy transformation, comprising:

generating a cycle control signal which includes ON-Time and OFF-Time; and adding a regulation energy of varying amplitudes or frequencies in the OFF-Time so as to perform a standby mode function during the OFF-Time to achieve an energy modulation of a high reliability and a wider dynamic range by mixing two or more cycles to control a power transfer component of a selected characteristic and keep an inverter and a load on a rear end to function in a reliable characteristic range.

2. The method of claim 1, wherein the cycle control signal is generated by an energy/time ratio synthesizing control unit according to a total energy control signal input to an input end thereof

3. The method of claim 2, wherein the total energy control signal has a selected width range ratio which ranges from 10% to 100%.

4. The method of claim 1, wherein the cycle control signal includes a control signal which is constant frequency and width modulation.

5. The method of claim 1, wherein the cycle control signal includes a control signal which is frequency modulation and constant width.

6. The method of claim 1, wherein the cycle control signal includes a control signal which is frequency modulation and width modulation.

7. The method of claim 1, wherein the OFF-Time includes a stop time which has an energy intensity of 0.

8. The method of claim 1, wherein the OFF-Time has a beginning period and an ending period that include a slowly rising zone and a slowly lowering zone to improve the transition period of energy intensity to prevent excitation dynamical ratio of the energy intensity from being excessively large.

9. The method of claim 1, wherein the ON-Time has a beginning period and an ending period that include a slowly rising zone and a slowly lowering zone to improve the transition period of energy intensity of the cycle control signal to prevent the excitation dynamical ratio of the energy intensity from being excessively large.

* * * * *